US009863128B2

(12) United States Patent
Yuan et al.

(10) Patent No.: US 9,863,128 B2
(45) Date of Patent: Jan. 9, 2018

(54) ADJUSTABLE JET VALVE

(71) Applicant: GUANGZHOU SEAGULL KITCHEN AND BATH PRODUCTS CO., LTD., Guangzhou, Guangdong (CN)

(72) Inventors: Xunping Yuan, Guangdong (CN); Zhiqiang Tang, Guangdong (CN)

(73) Assignee: GUANGZHOU SEAGULL KITCHEN AND BATH PRODUCTS CO., LTD., Guangdong (CN)

( * ) Notice: Subject to any disclaimer, the term of this patent is extended or adjusted under 35 U.S.C. 154(b) by 369 days.

(21) Appl. No.: 14/419,188

(22) PCT Filed: Sep. 26, 2013

(86) PCT No.: PCT/CN2013/084286
§ 371 (c)(1),
(2) Date: Feb. 2, 2015

(87) PCT Pub. No.: WO2014/173074
PCT Pub. Date: Oct. 30, 2014

(65) Prior Publication Data

US 2015/0204057 A1 Jul. 23, 2015

(30) Foreign Application Priority Data

Apr. 27, 2013 (CN) ..... 2013 1 0153987

(51) Int. Cl.
*E03C 1/08* (2006.01)
*F04F 5/10* (2006.01)
(Continued)

(52) U.S. Cl.
CPC ..... *E03C 1/08* (2013.01); *B05B 1/06* (2013.01); *B05B 1/326* (2013.01); *B05B 7/30* (2013.01);
(Continued)

(58) Field of Classification Search
CPC . E03C 1/08; E03C 1/0408; B05B 1/06; B05B 1/326; B05B 7/30; F04F 5/10; F04F 5/461; F04F 5/463; F16K 11/04
(Continued)

(56) References Cited

U.S. PATENT DOCUMENTS 4,239,732 A 12/1980 Schneider
5,228,604 A * 7/1993 Zanini ..... B67C 3/281 222/504
(Continued)

FOREIGN PATENT DOCUMENTS

CN 201007372 Y 1/2008
CN 102767210 A 11/2012
(Continued)

OTHER PUBLICATIONS

Written Opinion of the International Search Authority issued in the corresponding International Application No. PCT/CN2013/084286 dated Oct. 27, 2015 (5 pages).
(Continued)

*Primary Examiner* — Arthur O Hall
*Assistant Examiner* — Juan C Barrera
(74) *Attorney, Agent, or Firm* — Osha Liang LLP

(57) ABSTRACT

An adjustable jet valve includes a valve body containing a cold water opening, a hot water opening and a mixed water opening for outputting mixed water; a spray nozzle arranged in the valve body includes a cold water inlet and a cold water outlet connected to a cold water channel of a valve by means of the cold water opening; a spray needle assembled inside the spray nozzle forms a cold water inflow space with an inner chamber of the spray nozzle, and forms a cold water spray outlet with the cold water outlet of the spray nozzle;
(Continued)

and a throat pipe connected to the mixed water opening of the valve body for guiding the mixed water to flow into a device using mixed water.

18 Claims, 7 Drawing Sheets

(51) Int. Cl.

| | |
|---|---|
| ***F04F 5/46*** | (2006.01) |
| ***B05B 1/06*** | (2006.01) |
| ***B05B 1/32*** | (2006.01) |
| ***B05B 7/30*** | (2006.01) |
| ***E03C 1/04*** | (2006.01) |

(52) U.S. Cl.
CPC ..... *E03C 1/0408* (2013.01); *F04F 5/10* (2013.01); *F04F 5/463* (2013.01)

(58) Field of Classification Search
USPC ..... 137/625.4, 605, 607; 239/407, 416.4, 239/416.5, 417.3
See application file for complete search history.

(56) References Cited

U.S. PATENT DOCUMENTS

| | | | | |
|---|---|---|---|---|
| 7,802,588 | B2 * | 9/2010 | Doutt | F16K 11/044 137/606 |
| 8,079,382 | B2 * | 12/2011 | Wu | F16K 3/08 137/454.5 |
| 2009/0218536 | A1 * | 9/2009 | Wears | F16K 11/044 251/319 |
| 2009/0301605 | A1 * | 12/2009 | Mengibar Rivas | B67C 3/281 141/260 |
| 2013/0175365 | A1 * | 7/2013 | Ergut | F23D 14/22 239/407 |

FOREIGN PATENT DOCUMENTS

| | | | | |
|---|---|---|---|---|
| CN | 102909139 | A | 2/2013 | |
| CN | 203209229 | U | 9/2013 | |
| CN | 203214955 | U | 9/2013 | |
| CN | 203214961 | U | 9/2013 | |
| CN | 203230878 | U | 10/2013 | |
| CN | 203309162 | U | 11/2013 | |
| EP | 0390121 | A1 | 10/1990 | |
| GB | 604515 | A | 7/1948 | |
| WO | WO2011112711 | A2 * | 9/2011 | B05B 11/00 |

OTHER PUBLICATIONS

International Search Report issued in corresponding International Application No. PCT/CN2013/084286 with English translation dated Jan. 30, 2014 (10 pages).

English Translation of International Preliminary Report on Patentability Chapter II issued in corresponding International Application No. PCT/CN2013/084286 dated Nov. 4, 2015 (6 pages).

* cited by examiner

ADJUSTABLE JET VALVE

CROSS REFERENCE TO RELATED APPLICATIONS

This is a national stage application based on PCT/CN2013/084286, filed on Sep. 26, 2013, which claims priority to Chinese Patent Application No. CN 201310153987.6, filed on Apr. 27, 2013. This application claims the benefits and priority of these prior applications and incorporates their disclosures by reference in their entireties.

FIELD OF THE INVENTION

The present relates to a jet device for discharging water, in particular, an adjustable jet valve adapted for mixing cold-hot water in an application of a solar water heater.

BACKGROUND OF THE INVENTION

Currently, jet devices commonly used in solar water heaters are adapted for high-pressure systems, the pressure of which is provided via two methods.

One is to place the water heater on the roof for taking advantage of gravity drop to provide with pressure for hot water. However, once the gravity drop falls, it may cause problems such as less outflow of hot water because of the insufficiency of pressure provided. Hence, when people are taking a shower, they may feel uncomfortable because of the low temperature of water. Additionally, it may cause counter flow due to a considerable pressure discrepancy between hot water and cold water.

The other method is to dispose a pressure supplier in the water heater for providing pressure for hot water. Although it may solve some problems like insufficiency of pressure of hot water, the pressure supplier is added and the water heater is required for bearing pressure accordingly, which may greatly increase the cost and go against quantity production.

To solve the above described problems of prior art, China patent literature with publication No. CN102767210A discloses an adjustable jet device with multiple water sources, comprising a jet device body, a fluid chamber, a needle, a throat pipe, a diffuser, an inlet of the jet device (a cold water port), an inlet for sucked fluid (a hot water port), wherein the fluid chamber is disposed inside the jet device body, a nozzle is disposed at the front end of the fluid chamber, and the needle is disposed along the extension center line of the nozzle within the fluid chamber. Cold water with high pressure flows into the jet device through the inlet of the jet device and passes the fluid chamber till the nozzle. Then cold water is injected with high speed into the throat pipe along the needle, and negative pressure is formed in the throat pipe by entrainment effect, which may pump the hot water from the hot water port interconnected with the throat pipe. Based on the principle of entrainment effect of high speed jet, the invention of prior art may solve the problem of insufficiency of pressure for hot water supplied by non-confined water heater, and the energy of pumped fluid may be increased by high speed jet and the overall pressure of the device of the invention may be enhanced. However, it may still have some problems when using it.

In the present technology, the distance between the nozzle and the throat pipe is fixed, so as to form an opening, through which hot water flows into the throat pipe. No matter under what circumstances, water flowing out of the throat pipe always contains a certain proportion of hot water. Given this circumstance, the temperature of water flowing out of the throat pipe may not equal to the temperature of cold water, so that it may be too hot for people to take a shower and impossible to decrease, especially in summer.

Thus China patent literature with publication No. CN102086941B discloses a mixing valve comprising a valve body, a hot water port, an outlet. The mixing valve further comprises a nozzle in connection with a cold water port of the valve body; a cold water inlet and a cold water outlet are disposed on the nozzle; a chamber for adjusting water temperature is disposed in the valve body and is in connection with the hot water port; and a chamber for mixing water is disposed in connection with the outlet. The chamber for mixing water and the chamber for adjusting water temperature are in connection with each other through the outlet for hot water disposed at one end of the of the chamber for adjusting water temperature, and the chamber for mixing water is also in connection with the nozzle cold water outlet through the cold water outlet. For adjusting the flow of hot water, people only need to screw on or screw off the nozzle of the valve body for increase or decrease the cross section of the outlet for hot water, for adjusting the flow of cold water, people only need to screw on or screw off needle to adjust the cross section of the outlet of nozzle. It solves the problem of the jet device provided in China patent literature with publication No. CN102767210A, i.e. water flowing out of the throat pipe always combined with hot water. Thus people may feel more comfortable for taking a shower in summer. However, it still has some problems during the actual applications, which are:

1. For getting mixed water with comfortable temperature, people need to adjust the nozzle and the needle respectively in order to adjust the hot water inflow and the cold water inflow. However, during the actual application it may be difficult for the users to adjust the two valves simultaneously for adjusting mixed water temperature, and it is prone to be operated by mistake. Even when it is too hot for the user to take a shower and the cold water port is required to be turned up, the user may be scalded if they turn up the hot water port by mistake.

2. When the nozzle of prior art is adjusted in the axial direction of the adjustable jet valve, the pressure of cold water of the cold water inlet disposed thereon is kept the same with the pressure of cold water of the cold water port disposed on the valve body. When people screw on or screw off the nozzle, the needle is forced to rotate with the nozzle, meanwhile there is no relative motion between the nozzle and the needle, so as to maintain the cross section of the outlet for cold water. Thus, when the cross section of the cold water port is smaller than that of the outlet for cold water, the pressure of the cold water in the nozzle may be too low to get a good jet effect, or no jet is actuated. Thus for better jet effects, the needle is required to be adjusted as well for decreasing the cross section of the outlet for cold water, which means the needle and the nozzle are required to be adjusted simultaneously which is more difficult for the users. Otherwise water with comfortable temperature may not be surely discharged if people do not adjust the needle and the nozzle together. In the present invention, since the pressure of the cold water of the cold water inlet is kept the same with the pressure of the cold water of the cold water port, the problem mentioned above may not exist.

3. There is a problem that exists both in China patent literature with publication No. CN102086941B and China patent literature with publication No. CN 102767210 A, i.e. the needle within jet device is a slender structure with a tip. The cost for such needle is quite low, and when the fluid is passing the nozzle with a lower pressure, the needle with a slender structure bears low pressure in its radial direction, it may satisfy the working requirements. But if the fluid is passing the nozzle with a great or greater pressure and an instable fluid velocity, the needle may bear great and non-uniform radial pressure in its radial direction, i.e. along the length direction of the needle, different portions may bear different pressures, which may cause deviation of the needle from the spout of the nozzle as well as the radially swinging of the needle, and further impact the jet effect of the nozzle.

SUMMARY OF INVENTION

In view of the above described problems, one of the objectives of this invention is to provide an adjustable jet valve with a good jet effect and easy for using, yet not prone to be operated by mistake, so as to solve problems of jet valves of prior art, such as its jet effect is not so good, and it is complicated for the users to adjust the temperature of mixed water, which may be prone to being operated by mistake.

Another objective of the present invention is to provide an adjustable jet valve that can work stably under different fluid pressures and velocities.

To solve the above-described problems, an adjustable jet valve is provided in the present invention, comprising a valve body with a cold water port, a hot water port and an mixing outlet for mixed water disposed thereon; a nozzle disposed in the valve body, having a cold water inlet in connection with a cold water passage of a valve through the cold water port, and a cold water outlet; a needle assembled in the nozzle, forming a cold water inflow space with an inner cavity of the nozzle, and forming a cold water jetting outlet with the cold water outlet; a throat pipe disposed in connection with the mixing outlet of the valve body, adapted for discharging mixed water to relative devices receiving mixed water; wherein the needle is unmovable in the axial direction of the adjustable jet valve, while the nozzle is adjustable in the axial direction of the adjustable jet valve. The fluid flow rates of the cold water inflow space, the hot water port and the cold water jetting outlet may be adjusted simultaneously through axially adjusting the nozzle.

In a class of this embodiment, the adjustable jet valve further comprises a rotatable member rotatably disposed in the valve body in a sealing manner, which is in connection with the needle so as to actuate the needle to rotate together; the nozzle may be axially adjusted relative to the rotatable member and coordinated therewith through an axially adjusting mechanism; the valve body is coordinated with the nozzle through a rotation limiting part, adapted for stopping the nozzle to rotate relative to the valve body when the needle is rotated by the rotatable member. However, the nozzle may be displaced in the axial direction of the needle through the axially adjusting mechanism.

In a class of this embodiment, the axially adjusting mechanism comprises an internal thread formed on the nozzle and an external thread formed on the rotatable member and adapted for being engaged with the internal thread, and the stroke for engagement of the internal thread and the external thread may be no less than the distance between the cold water outlet of the nozzle and the throat pipe.

In a class of this embodiment, the rotation limiting part may be a polygonal end portion formed on the nozzle, and the inner wall of the valve body is fitted therewith.

In a class of this embodiment, the rotation limiting part is a flange circumferentially arranged in the end of the nozzle and a guiding groove axially arranged in the inner wall of the valve body sliding fitted therewith.

In a class of this embodiment, the rotation limiting part comprises a flange arranged in the inner wall of the valve body and a guiding groove axially arranged in the end of the nozzle sliding fitted therewith.

In a class of this embodiment, said cold water inlet and said cold water outlet of said nozzle have a pair of circumferential flanges formed therebetween extending radially outward, and said circumferential flanges allow a sealing element to be disposed therebetween, and a hot water segment of said nozzle located between said circumferential flanges and said cold water outlet is able to be communicated with a hot water passage of the valve.

In a class of this embodiment, the throat pipe is assembled in the valve body formed the hot water port in connection with a hot water passage and the throat pipe, and the throat pipe comprises a path pipe and an expanding pipe.

In a class of this embodiment, said path pipe has an inner diameter between 5 mm and 14 mm, and the length of said path pipe is 5 to 8 times of said inner diameter.

In a class of this embodiment, the cold water outlet of the nozzle has a diameter between 3 mm and 10 mm.

In a class of this embodiment, said needle comprises a needle body and a conical portion located on one end of said needle body and coordinated with said cold water outlet of said nozzle; said needle body is circumferentially provided with a supporting member so as to allow outer surface of said supporting member to coordinate with the inner cavity of said nozzle, in order to limit the position of said needle body and to form a fluid passage on said supporting member, as said needle is disposed inside said nozzle.

In a class of this embodiment, the supporting member comprises a plurality of ribs circumferentially and uniformly arranged around the needle body in the axial direction, and the fluid passage is formed among the ribs.

In a class of this embodiment, said rib comprises a first rib part and a second rib part; said first rib part is arranged towards said cold water inlet of said nozzle and has a radial dimension smaller than that of said second rib part, so as to coordinate with said inner wall of said nozzle to form said fluid passage, and the outer surface of said second rib part is fitted with the inner cavity of said nozzle.

In a class of this embodiment, the number of the ribs may be three or four or five or six; the sum of the cross section of all fluid passages formed between said ribs is larger than the cross section of said cold water outlet of said nozzle.

In a class of this embodiment, a water pressurizing and mixing segment is disposed between the conical portion and the supporting member of the needle body, and the shape of the water pressurizing and mixing segment is a cylinder.

In a class of this embodiment, the diameter of the water pressurizing and mixing segment is larger than, equal to or smaller than the diameter of a spout of the nozzle.

In a class of this embodiment, the diameter of the conical portion declines from its root to its front end, and the length of the conical portion may be smaller than or equal to the movable stroke of the nozzle.

In a class of this embodiment, the diameter of the conical portion of the needle declines continuously from its root to its front end.

In a class of this embodiment, when the nozzle is displaced in the axial direction of the adjustable jet valve, the cold water inlet disposed thereon is always corresponding to the cold water port of the valve body.

Advantages of this invention are summarized below:

1. It is disclosed in the present invention that the needle is unmovalbe in the axial direction of the adjustable jet valve, and the nozzle is adjustable in the axial direction of the adjustable jet valve, so that the cold water inflow space, the hot water port and the cold water jetting outlet can be adjusted simultaneously through axially adjusting the nozzle. It solves the problems of the adjustable jet valve of prior art, such as people need to adjust the nozzle and the needle respectively for adjustment of the hot water inflow and the cold water inflow, which is complicated for people to operate and prone to be operated by mistakes. Furthermore, the adjustable jet valve of the present invention is easy for people to operate because the hot water inflow and the cold water inflow can be adjusted through axially displacing the nozzle.

2. It is disclosed in the present invention that the needle is disposed in the nozzle, forming a cold water inflow space and a cold water jetting outlet with the nozzle, and nozzle inlet for cold water is in connection with the cold water port and the cold water inflow space respectively. The cold water inflow space, the hot water port and the cold water jetting outlet can be adjusted through adjusting the nozzle to displace in the axial direction of the adjustable jet valve during the usage. More specifically, when the cold water jetting outlet becomes smaller due to the displacement of the nozzle, the hot water port becomes larger, so that the temperature of the mixed water may be adjusted in an easier manner. More importantly, in the present invention, the pressure of the cold water port is kept the same as that of the cold water jetting outlet, so that even if the amount of the cold water flowing into the cold water port is small, the water of the cold water inflow space and the cold water jetting outlet can be ensured with high pressure for a better jet effect. Thus, the better jet effect can be provided by the adjustable jet valve of the present invention in an easy manner.

3. It is disclosed in the present invention that the adjustable jet valve further comprises a rotatable member rotatably disposed in the valve body in a sealing manner, which is in connection with the needle so as to actuate the needle to rotate together. The rotatable member can be made of relatively inexpensive materials compared with the needle, so as to reduce the cost for manufacturing the adjustable jet valve of the present invention.

4. It is disclosed in the present invention that the axially adjusting mechanism comprises the internal thread formed on the nozzle and the external thread formed on the rotatable member fitting with the internal thread. Since the rotatable member cannot be displaced in the axial direction of the adjustable jet valve as well as the nozzle cannot rotate relative to the valve body due to the limitation of the rotation limiting part, the external thread may be fitted with the internal thread of the nozzle during the rotation of the rotatable member, so as to displace the nozzle in the axial direction of the adjustable jet valve. The above described structure is simple, easy for installing and processing.

5. It is disclosed in the present invention that the rotation limiting part is a polygonal end portion formed on the nozzle and the inner wall of the valve body is fitted therewith. Such structure is simple, easy for processing and reliable for usage.

6. It is disclosed in the present invention that the throat pipe comprises a path pipe and an expanding pipe; negative pressure of the cold water injected with high speed is formed in the path pipe so as to generate entrainment effect, and the hot water is sucked into the path pipe through the hot water port for mixing with the cold water and transmitting energy therewith. The mixed water still has high speed and large kinetic energy, and because of the expanding pipe, part of the kinetic energy of the mixed water with high velocity can be transformed into pressure energy, so as to enhance the jetting pressure of the mixed water, which is conducive to inject the mixed water into the device receiving the mixed water.

7. It is disclosed in the present invention that the needle comprises a needle body and a conical portion located at the end of the needle body and fitted with the cold water outlet of the nozzle; the needle body is circumferentially provided with a supporting member so as to allow outer surface of the supporting member to coordinate with the inner cavity of the nozzle, in order to limit the position of the needle body and to form a fluid passage on the supporting member, as the needle is disposed inside the nozzle. It solves the problems of prior art such as the needle bears a greater pressure of the fluid, or the deviation or the radially swinging of the spout of the nozzle because of the instability of the fluid velocity. The jet effect may be improved due to the limitation of the position of the needle body through the attachment between the surface of the supporting member and the wall of the inner cavity of the nozzle.

BRIEF DESCRIPTION OF THE DRAWINGS

Detailed description will be given below in conjunction with accompanying drawings.

Figure 1:
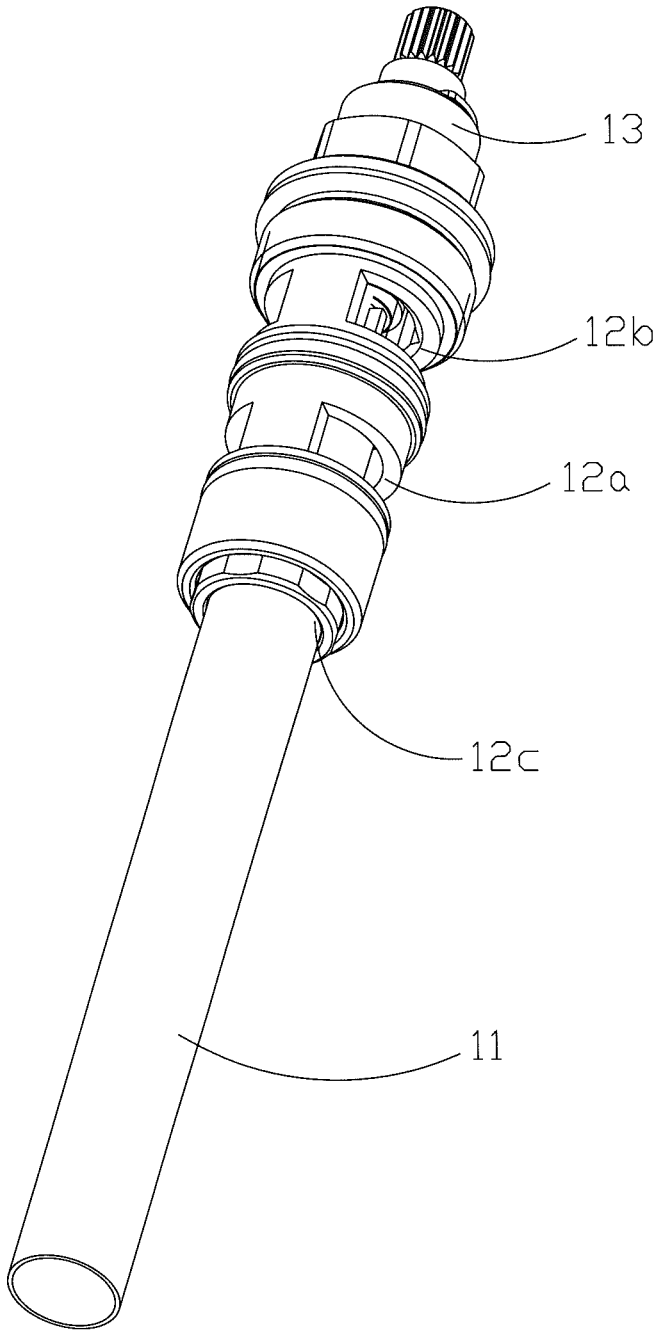
FIG. 1 is a perspective diagram of an adjustable jet valve of the present invention.

In the drawings, the following reference numbers are used:

1—needle body, 1*a*—water pressurizing and mixing segment, 2—conical portion, 2*a*—root, 2*b*—front end, 3—fluid passage, 4—rib, 41—first rib part, 42—second rib part, 9—nozzle, 91—nozzle inlet for cold water, 92—cold water outlet, 93—polygonal end portion, 94—circumferential flange, 95—hot water segment, 96—nozzle conical portion, 11—throat pipe, 11*a*—path pipe, 11*b*—expanding pipe, 12—valve body, 12*a*—opening for hot water, 12*b*—opening for cold water, 13—rotatable member, 15—cold water inflow space, 16—cold water jetting outlet, β—expanding angle.

DETAILED DESCRIPTION OF THE PREFERRED EMBODIMENTS

The embodiments of this invention will be illustrated in detail in combination with the accompanying figures as below. It should be understood that the embodiments described here are used to illustrate this invention rather than limit the scope of this invention.

Figure 2:
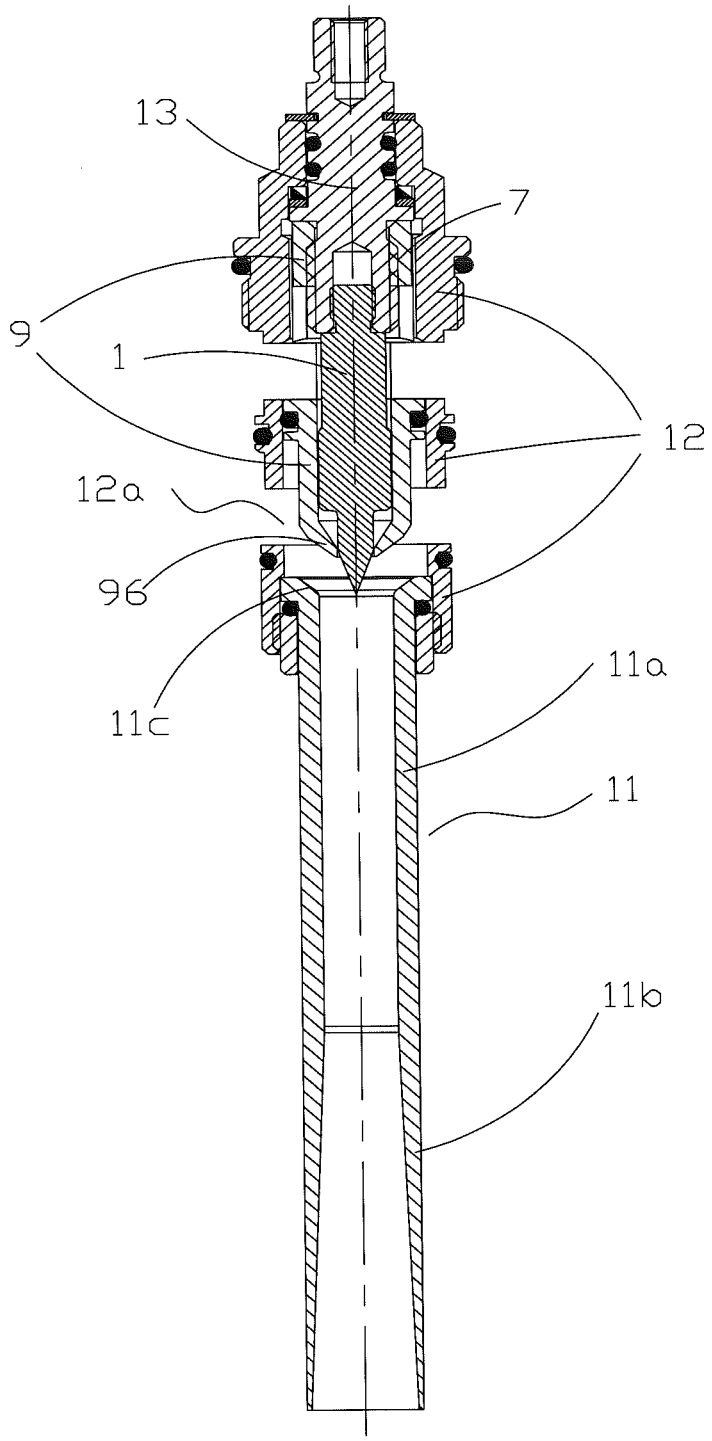
FIG. 2 is a sectional view of an adjustable jet valve of the present invention.

FIG. 1 and FIG. 2 show an embodiment of an adjustable jet valve adapted for being mounted in a valve, comprising a valve body 12 provided with a cold water port 12*b*, a hot water port 12*a* and a mixing outlet for mixed water disposed thereon, wherein said cold water port 12*b* is adapted for communicating with a cold water passage of the valve, and said hot water port 12*a* is in connection with an outlet for hot water of a hot water passage of the valve and said mixing outlet is adapted for discharging mixture of hot water and cold water. The adjustable jet valve further comprises a nozzle 9 disposed within the valve body, having a cold water inlet and a cold water outlet, wherein the cold water inlet is in connection with the cold water passage of the valve through the cold water port 12*b*. The adjustable jet valve further comprises a needle assembled in the nozzle, together with the inner cavity of the nozzle to form a cold water inflow space 15 as well as together with the cold water outlet to form a cold water jetting outlet 16; a throat pipe in connection with the mixing outlet of the valve body, in order to discharge the mixed water.

Furthermore, the needle is unmovable in the axial direction of the adjustable jet valve, while the nozzle is adjustable in the axial direction of the adjustable jet valve. The cold water inflow space 15, the hot water port and the cold water jetting outlet 16 may be adjusted simultaneously by adjusting the nozzle in the axial direction. Specifically, the working principle will be explained as follows. The distance between the needle and the throat pipe 11 is fixed, and the nozzle 9 is adjustable in the axial direction between the needle and the throat pipe 11. When the nozzle moves towards the tip of the needle, the cold water inflow is decreased while the hot water inflow is increased, so as to increase the temperature of the mixed water; when the nozzle moves towards the throat pipe 11, the cold water inflow is increased while the hot water inflow in decreased, so as to decrease the temperature of the mixed water.

Hence, when using the adjustable jet valve of the present embodiment, people only need to axially adjust the nozzle 9 so as to adjust the cold water inflow space 15, the hot water port 12*a* and the cold water jetting outlet 16 simultaneously. It solves the problem of the adjustable jet valve of prior art, i.e. for getting mixed water with comfortable temperature, both of the needle and the nozzle are required to be adjusted, which is quite difficult for the users and prone to be mishandled.

In addition, in this embodiment, refer to FIG. 2, when the nozzle 9 is displacing in the axial direction of the jet valve, the cold water pressure of the cold water inlet 91 disposed thereon is kept the same with the cold water pressure of the cold water port 12*b* disposed on the valve body 12, which may be realized in two following methods.

The length of the cold water inlet 91 in the axial direction of the needle may be larger than or equal to the length of the cold water port 12*b* in the axial direction plus the stroke of the nozzle 9, so that the cold water port 12*b* may be kept within the length range of the cold water inlet 91 during the displacement of the nozzle 9, in order to keep the pressure for jetting cold water from the inner of the nozzle.

Alternatively, the length of the cold water port 12*b* in the axial direction of the needle may be larger or equal to the length of the cold water inlet 91 in the axial direction plus the stroke of the nozzle 9, so that the cold water inlet 91 may be kept within the length range of the cold water port 12*b* during the displacement of the nozzle 9, in order to keep the pressure for jetting cold water from the inner of the nozzle.

The pressure of the cold water port 12*b* may be ensured to keep the same with that at the cold water outlet 16 via the two above described methods, avoiding the pressure of the cold water inlet from being lower than that of the cold water jetting outlet 16 during the axial displacement of nozzle 9 of prior art. In the prior technology, if the pressure of the cold water inlet is lower than that of the cold water jetting outlet 16, due to the structural limitation of the valve itself, people have to adjust the needle in the axial direction again to make the pressure of the cold water outlet 16 be greater or equal to that of the cold water inlet of the nozzle 9, thus making the cold water be jetted normally.

In order to facilitate the adjustment of the nozzle 9 in the axial direction of the valve body 12 much more conveniently, furthermore, the adjustable jet valve provided in the present embodiment further comprises a rotatable member 13 for facilitating displacing the nozzle 9 in the axial direction, which is sealed through an O-shaped ring and the like and rotatably disposed on the valve body 12. Additionally, the rotatable member 13 is displaced relative to the nozzle 9 in the axial direction through an axially adjusting mechanism (described later), so as to axially displacing the nozzle 9 via the rotation of the rotatable member 13.

Specifically, for example, the axially adjusting mechanism may be racks and gears fitted with each other for transmission, i.e. the racks are arranged on the nozzle 9 so as to axially displace the nozzle 9 through the gearing of the rotatable member 13 and the gears.

As a preferred embodiment, refer to FIG. 1 and FIG. 2, the rotatable member 13 is in connection with the needle so as to drive the needle to rotate together. More specifically, for easier process, an internal threaded hole is formed at the end of the rotatable member 13 that is in connection with the needle, and an external thread is arranged at the end of the needle, so that the rotatable member 13 and the needle may be fitted with each other through the threads. Alternatively, the rotatable member 13 and the needle may be formed integrally.

Meanwhile, the valve body 12 is fitted with the nozzle 9 through a rotation limiting part (described in details later), so that the nozzle 9 cannot rotate relative to the valve body 12 during the rotation of needle driven by the rotatable member 13. However, the nozzle 9 may be displaced relative to the valve body 12 in the axial direction of the needle driven by the axially adjusting mechanism.

Specifically, the axially adjusting mechanism may comprise an internal thread and an external thread, wherein said internal thread is formed on the end of the nozzle 9 that is fitted with the rotatable member 13, and the external thread is formed on the rotatable member 13, adapted for fitting with the internal thread; wherein the engaging stroke of the internal thread and the external thread may be greater than or equal to the movable stroke of the nozzle, which is, when the nozzle 9 is in the position where the cold water passage is closed, shown in FIG. 2, the distance between the cold water outlet 92 and the throat pipe 11. Refer to FIG. 1 and FIG. 2, the needle is driven to rotate in the inner cavity of nozzle 9 by the rotation of the rotatable member 13, and the rotation limiting part may obstruct the nozzle 9 from rotating relative to the valve body 12. Meanwhile, because the nozzle 9 is fitted with the rotatable member 13 by the threads, it may cause the reciprocating motion of the nozzle 9 in the axial direction of the needle with the threads, so as to adjust the cold water inflow space 15, the hot water port 12*a* (shown in FIG. 2) and the jet outlet of cold water 16 simultaneously, which is quite convenient.

Additionally, for the mechanism adapted for driving the needle to rotate through the rotatable member 13, the axially adjusting mechanism may be designed in various ways. For example, the axially adjusting mechanism may comprise skew gears and racks fitted with each other, adapted for displacing the racks through the rotation of the skew gears, i.e. the nozzle 9 is moving in the axial direction of the needle through rotatable member 13 on which the skew gears are arranged, and the racks are arranged on the nozzle 9 rotatable member.

For driving the needle to rotate by the rotatable member 13, and displacing the nozzle 9 relative to the valve body 12 in the axial direction of the needle through the axially adjusting mechanism 7 without rotation, a rotation limiting part is provided in the present embodiment. The valve body 12 is fitted with the nozzle through the rotation limiting part, so as to displace the nozzle relative to the valve body in the axial direction of the needle through the axially adjusting mechanism, but not rotate relative to the valve body when the needle is driven to rotate by the rotatable member. It is disclosed in a preferred embodiment that the rotation limiting part is a polygonal end portion formed on the nozzle, shown in FIG. 4. Correspondingly, the inner wall of the valve body is shaped so as to be coordinated with the polygonal end portion, so that when the external thread of the rotatable member 13 is fitted with the internal thread of the nozzle 9, the nozzle 9 may be displaced in the axial direction of the needle without rotation due to the restriction of the rotation limiting part.

As an alternative embodiment, the rotation limiting part comprises a flange arranged on the inner wall of the valve body and a guiding groove arranged on the side of the nozzle in the axial direction that is sliding fitted with the flange. It should be understood that the rotation limiting part might also be designed in various ways. For example, it can be a guiding groove arranged on the inner wall of the valve body as well as a flange arranged on the side of the nozzle in the axial direction which may be sliding fitted with the guiding groove.

Figure 3:
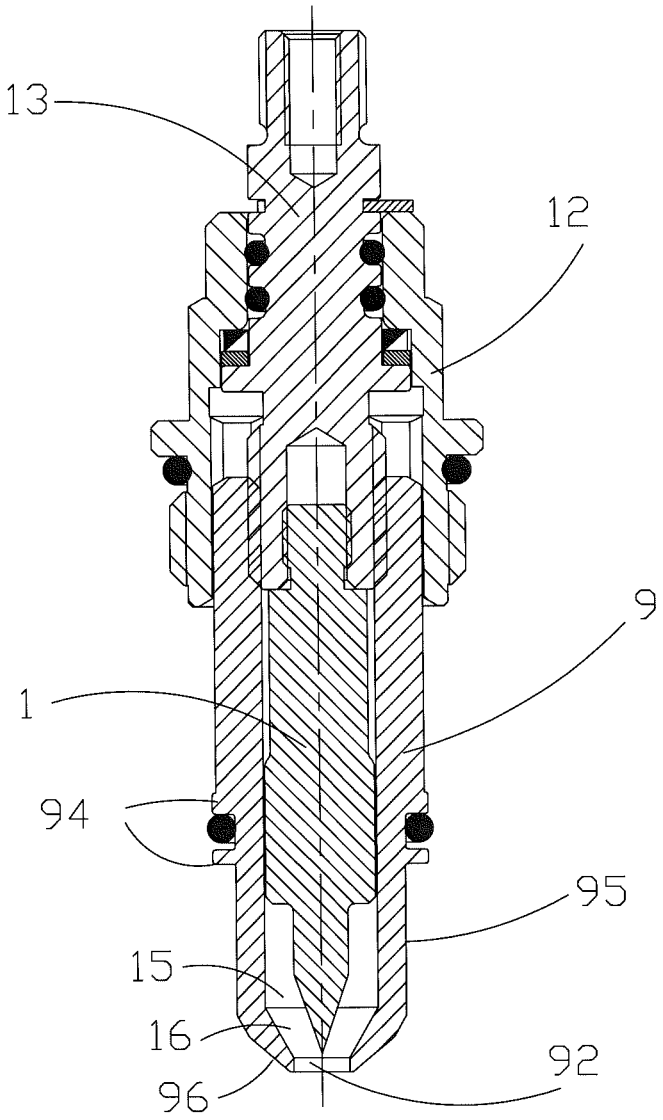
FIG. 3 is a structural diagram of the combination between the nozzle and the needle of the present invention.
Figure 4:
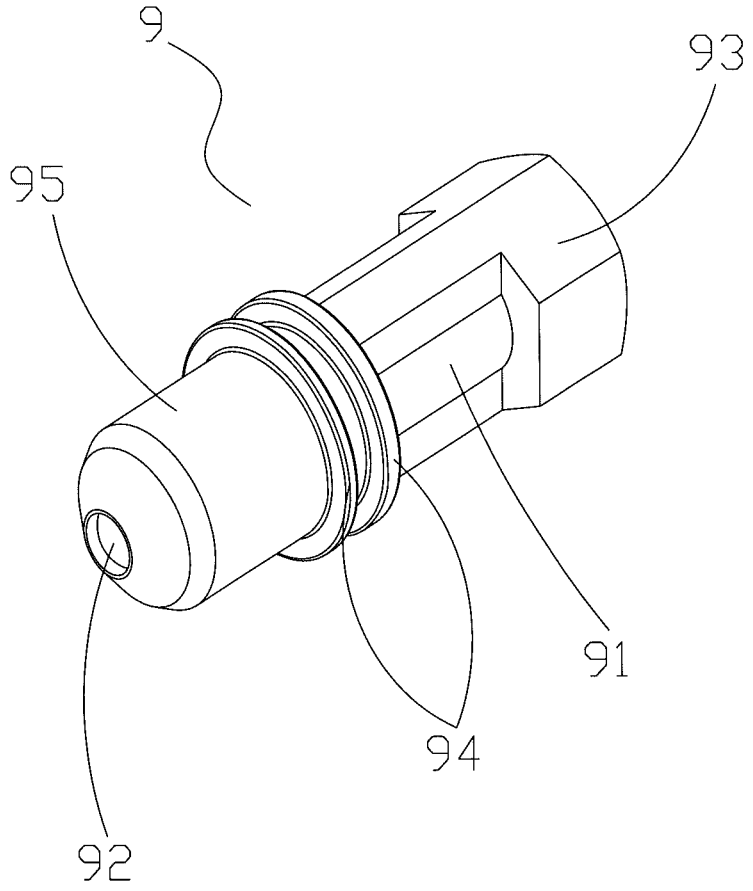
FIG. 4 is a perspective diagram of the nozzle of the present invention.

Refer to FIG. 3 and FIG. 4, it is provided in the present embodiment that a pair of circumferential flanges extend outward radially are formed between the cold water inlet and the cold water outlet, and a hot water segment of the nozzle located between the circumferential flanges and the cold water outlet may be connected with the hot water passage of the valve, so that the hot water port 12*a* may be separated from the cold water inlet 91 and the cold water port 12*b*, which disposed in the valve body 12 and connected with the cold water inlet 91, for better jet effects of the adjustable jet valve provided in the present invention. For entirely separating the cold water port 12*b* from the hot water port 12*a* to get a better sealing, during the assembly process, a sealing member is disposed between the circumferential flanges, adapted for making the surface of the circumferential flanges tightly fit with the inner wall of the nozzle 9, such as a sealing ring, so as to get better effects of sealing.

Refer to FIG. 1 and FIG. 2, it is provided in the present embodiment that the throat pipe 11 is disposed in the valve body 12, and the valve body is provided with a hot water port formed thereon which is in connection with a hot water passage and the throat pipe. The throat pipe 11 is adapted for intensively mixing the hot water and the cold water and exchanging energy. The throat pipe 11 comprises a path pipe 11*a* and an expanding pipe 11*b*. In the present embodiment, the path pipe has an inner diameter between 5 mm and 14 mm, preferably between 6 mm and 10 mm. However, it should be understood that the inner diameter of the path pipe should not be limited within such range, which may be within a larger range according to various requirements. In the present embodiment, the inner diameter of the path pipe 11*a* is 8 mm. The length of the path pipe may be 5-8 times of the inner diameter, preferred 6 times.

Figure 7:
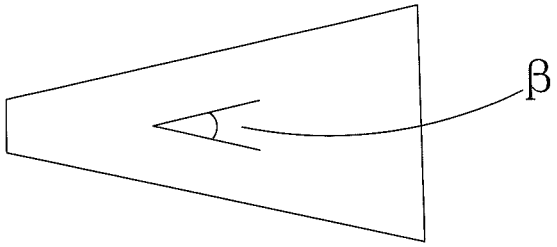
FIG. 7 is a diagram of one embodiment of the expanding pipe of the throat pipe of the present invention.
Figure 8:
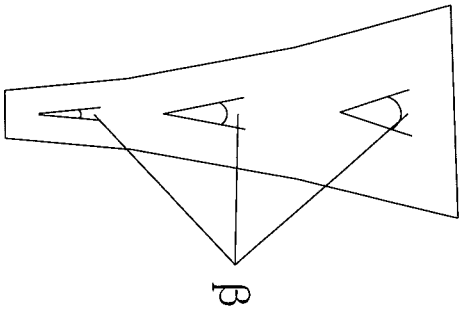
FIG. 8 is a diagram of another embodiment of the expanding pipe of the throat pipe of the present invention.

Refer to FIG. 7, it is provided in the present embodiment that the expanding pipe 11*b* is adapted for converting part of the kinetic energy of the mixed water into pressure energy, the mixed water coming from the outlet of the throat pipe 11. During such energy conversion, there may be diffusion losses and its amount is relevant to the distribution of the inflow speed of the inlet of the expanding pipe 11*b*, the expanding angle and the ratio of the diameters of the cross section of the expanding. As a preferred embodiment, the expanding angle is between 5° and 15°, but not restricted within that range, preferred 12°. In the present embodiment, the expanding pipe 11*b* preferably expands in a continuous linear manner. However, it also can expand in various manners such as stepped continuous manner without any restriction of the specification forms. Furthermore, in the present embodiment, the expanding pipe 11*b* expands from its smaller opening to its larger opening continuously. It is preferred that the expanding pipe 11*b* comprises three sections, shown in FIG. 8, and the expanding angle β of each section is preferred to be 2°, 4°, 13° respectively. Alternatively, the angle also can be 1°, 3°, 12°, or other various angles fitted therewith according to different working requirements.

It is provided in the present embodiment that the cold water outlet of the nozzle 9 has a diameter between 3 mm and 10 mm, preferred between 4 mm and 6 mm. However, the protection scope of this invention may not be restricted within such range. In this embodiment, the diameter is 5 mm.

When the pressure of the fluid with an instable flow velocity passing through the cold water inlet 91 is great, the needle provided in the present invention may not be affected and still have better jet effects. In order to achieve this effects, in the present embodiment shown in FIG. 1, FIG. 2 and FIG. 5, the needle comprises a needle body 1 and a conical portion, and the conical portion is disposed on the end of the needle body 1 and coordinated with the cold water inlet, and the needle body 1 is circumferentially provided with a supporting member so as to allow outer surface of the supporting member to coordinate with the inner cavity of the nozzle, in order to limit the position of the needle body 1 and to form a fluid passage 3 on the supporting member, as the needle is disposed inside the nozzle 9.

During the practical application of the needle illustrated above, even if the pressure of the fluid passing through the nozzle 9 is great with instable flow velocity, which means in the axial direction of the needle, even if the different portions of the needle may bear quite different radial pressures with others, the needle is adapted for preventing itself from deviating from the spout of the nozzle 9 or radially dithering or swinging due to the great and non-uniform radial pressure under the needle in its radial direction, without affecting the smooth flow of the fluid, thus adapted for preventing from affecting the effects of jet from the nozzle 9 to the spout 10.

According to the function of the supporting member illustrated before, this supporting member can also be designed in various ways according to actual application. Some structures of the supporting members may be illustrated in details with the accompanying drawings. However, it should be noted the supporting member might not be limited to the following exemplary structures, and any variations, alternatives or amendments would be understood by the skilled in the art.

FIG. 1 illustrates a first structure of the supporting member, comprising a plurality of ribs 4 circumferentially and uniformly arranged around the needle body 1 and extending in the axial direction of the needle, and forming the fluid passage 3 between the ribs 4, so that after assembly of the nozzle and the needle, the ribs 4 may be attached to the inner cavity of the nozzle, adapted for limiting the position of the needle body 1.

For processing the ribs, the mechanical methods may be used such as cutting, or some methods may be used to form the ribs 4 on the needle body 1 in one-step such as casting and injecting, according to practical requirements.

Additionally, for enhancing the jet effects of the nozzle, the ribs 4 comprise a first rib part 41 and a second rib part 42, and the first rib part 41 is arranged towards the cold water inlet 91 and has a radial dimension smaller than that of the second rib part 42, so as to coordinate with the inner wall of the nozzle to form the fluid passage 3, and the outer surface of the second rib part 41 is fitted with the inner cavity of the nozzle. By improving the structure of the ribs 4, it improves the jet effect of the nozzle 9 as well as the limitation of the position of the needle by the supporting member.

When the position of the needle is limited by the supporting member, the needle may displace back and forth in the axial direction of the nozzle, as well as rotate in the nozzle.

Of course, during the practical application, a groove may be formed in the inner wall of the nozzle 9, and the groove corresponds to the second rib part 42 and extends in the axial direction of the nozzle 9. The second rib part 42 may be engaged within the groove and slide along the axial direction of the nozzle. In such structure, the groove is adapted for guiding the movement of the needle as well as preventing the needle from rotating, which means the needle can only displace back and forth in the axial direction of the nozzle without rotation.

For facilitating process, it is preferable that the number of the ribs may be three, four, five or six, preferably four. However, there is no limitation for the number of the ribs in the present invention as long as the technical effects of this invention will be achieved. The sum of the cross section of all fluid passages 3 formed between the ribs 4 is larger than the cross section of the cold water outlet 92 of the nozzle 9. It is ensured that the pressure of the cold water outlet 92 is great enough for good jet effects of the cold water jetting outlet 16.

FIG. 4 illustrates a second structure of the supporting member, which is an annular supporting plate 5 disposed on the needle body 1, and a plurality of diversion openings 6 are formed on the annular supporting plate 5, being used as the fluid passage.

The annular supporting plate 5 may have a certain thickness according to actual requirements. Additionally, the shape of the diversion opening 6 may not be limited to a circular hole shown in FIG. 4 but a fan shaped hole. Meanwhile, the diversion opening 6 should be designed for little impact or no impact on the flow velocity of the fluid passing by. For example, the connection portion between the diversion opening 6 and the annular supporting plate 5 is preferred to be a circular arc in favor of flowing of the fluid.

FIG. 3 illustrates a third structure of the supporting member, which is a circular ring 7 in connection with the needle body 1 through a plurality of ribs 8, and fluid passage 3 is formed therebetween.

The shapes of circular ring 7 and the ribs 8 are designed for smooth flowing of the fluid, for little impact or no impact.

It should be noted that the structure of the supporting member should not be restricted to the above described examples.

Furthermore, refer to FIG. 1 and FIG. 2, a water pressurizing and mixing segment 1*a* is disposed between the supporting member of the needle body 1 and the conical portion 2, the shape of which is a cylinder, so that after assembling the needle and the nozzle, a cold water inflow space 15 may be formed between the water pressurizing and mixing segment 1*a* of the needle and the wall of the inner cavity of the nozzle, shown in FIG. 2. It ensures that before the fluid flowing through the fluid passage flows into the jetting cone formed between the conical portion 2 and the spout 10, it may be fully mixed and pressurized, so as to ensure a good jet effect of the spout 10 of the nozzle 9. In the present embodiment, the length of the water pressurizing and mixing segment 1*a* is 7 mm.

Refer to FIG. 2, when the needle is moving towards the spout 10 in the axial direction of the nozzle 9, the conical portion 2 of the needle is gradually fitted with the spout 10. Thus, for preventing cold water from jetting out of the spout 10 when the conical portion 2 is fully fitted with the spout 10, preferable, the diameter of the water pressurizing and mixing segment 1*a* may be larger than, equal to or slightly smaller than the diameter of the spout 10 of the nozzle. Here, the meanings of "larger" and "slightly smaller than" are: if the diameter of the root of the conical portion is greater than that of the cold water outlet 92 of the nozzle 9, the nozzle 9 is displaced in the axial direction. When the hot water port 12*a* is maximized opened, and the cold water jetting outlet 16 is closed, the edge of the cold water outlet 92 of the nozzle 9 contacts with the edge of the conical portion of the needle, so as to close the cold water jetting outlet 16; if the diameter of the root of the conical portion of the needle is a little bit less than the diameter of the cold water outlet 92 of the nozzle 9, the nozzle 9 is displaced in the axial direction. When the hot water port 12*a* is maximized opened, the conical portion of the needle passes through the cold water outlet 92 of the nozzle 9 so as to close most part of the cold water jetting outlet 16. An extremely small gap may be maintained between the conical portion of the needle and the cold water outlet 92 for cold water to flow by. At this moment, the hot water port 12*a* is entirely opened and the cold water flowing through the gap may be ignored.

It should be noted that the length of the water pressurizing and mixing segment 1*a* provided in the present embodiment might not be too short, otherwise there might be possibilities of bifurcation of the water discharged from the nozzle. Specifically, the length of the water pressurizing and mixing segment 1*a* is relevant to the cross section of the flow path, the cross section of the spout of the nozzle and the thickness of the supporting member. However the impact will not be significant.

Figure 5:
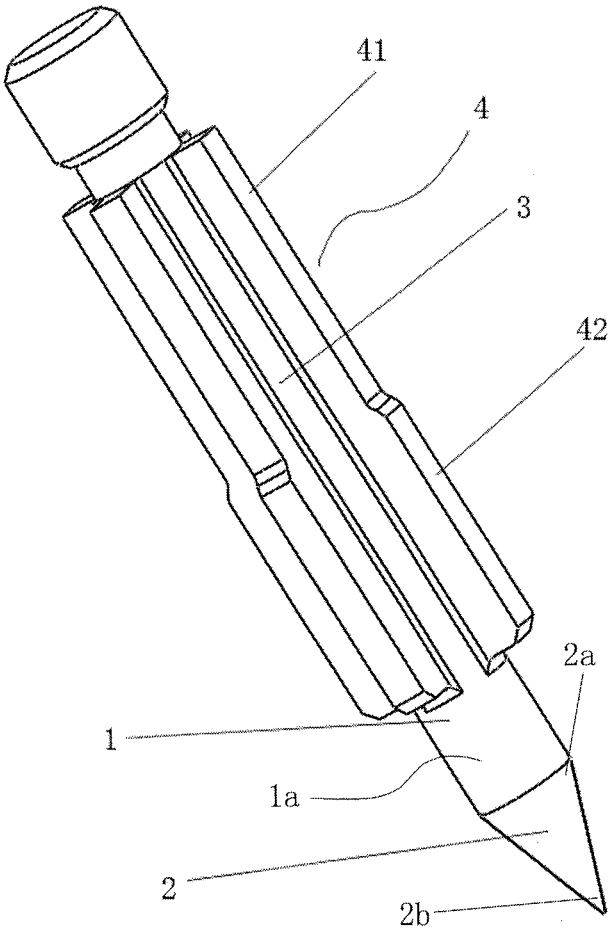
FIG. 5 is a perspective structural diagram of the needle of the present invention.
Figure 6:
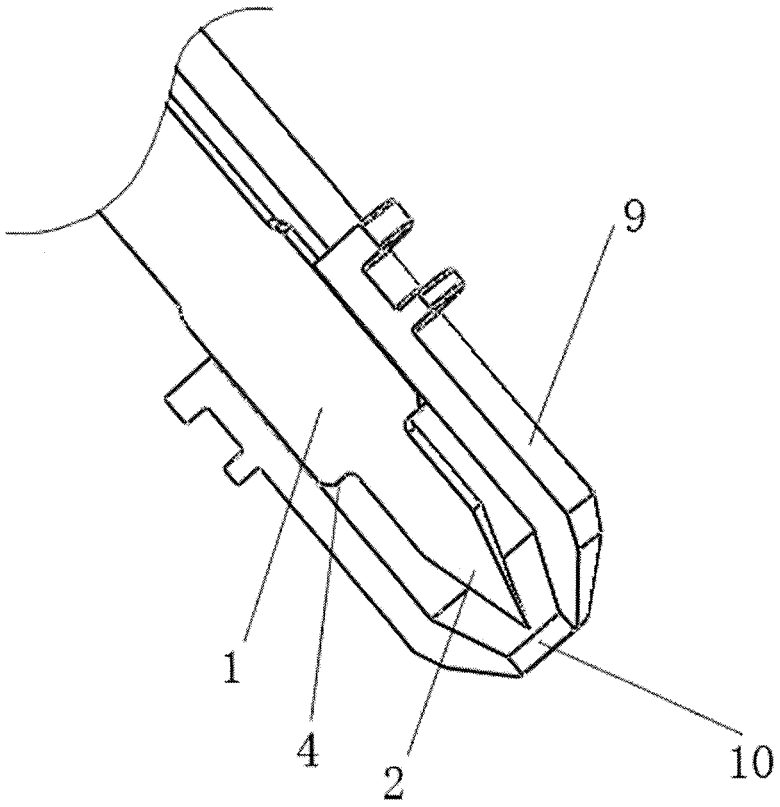
FIG. 6 is a sectional view of the perspective structure of the nozzle of the present invention.

In addition, refer to FIG. 5, the diameter of the conical portion 2 is decreasing from its root 2*a* to its front end 2*b*, with a conicity between 20° and 90°, including 20° and 90°, preferred 30°. After assembling the needle and the nozzle 9, the length of the conical portion 2 may be smaller than or equal to the movable stroke of the nozzle 9, so as to fit the cold water outlet 92 with the conical portion 2 appropriately.

Accordingly, the conicity of the cold water outlet 16 is larger than or equal to that of the conical portion 2 of the needle. Hence, in the present embodiment, the conical portion of the nozzle has a conicity between 30° and 100°, preferred 60° in this embodiment.

Furthermore, the diameter of the conical portion 2 is continuously decreasing from its root 2*a* to its front end 2*b*, i.e. the conical portion 2 is a cone. For smooth flow of the fluid, refer to FIG. 2, the conical portion 2 may be combined with the cold water outlet 92 of the nozzle 9 in a linear manner. Alternatively, the surface of the conical portion 2 also may be structured in a non-linear in accordance with the fluid mechanics or be structured in a parabolic manner, so that proper adjustments may be made automatically according to different flowing velocities.

It is noted that the parameters for every element of the jet mixer provided in the present invention have a significant impact upon the effects of the absorption of hot water of the jet mixer. It is proved via experiments that the vacuum adsorption is quite good even when the inflow of the cold water is on a lower level due to the jet mixer with the specific parameters. The testing result is listed in the following table 1.

| Test condition pressure of the cold water port (Mpa) | adjusting for lowest inflow of cold water negative pressure for absorbing hot water (meter water column) |
|---|---|
| 0.05 | −0.29 |
| 0.1 | −0.48 |
| 0.15 | −0.8 |
| 0.2 | −1 |

Obviously, the above embodiments are merely used for clearly describing the examples rather than limiting the scope of the invention. Those ordinary skilled in the art can also make changes or variations in other different forms on the basis of the above description. It is unnecessary to describe all the implementation ways herein. However, the obvious changes or variations derived from the invention still fall in the scope of protection of the present invention.

What is claimed is:

1. An adjustable jet valve, comprising:

a valve body, provided with a cold water port, a hot water port and a mixing outlet for mixed water disposed thereon;

a nozzle disposed in said valve body, having a cold water inlet communicated with a cold water passage of a valve through said cold water port, and a cold water outlet;

a needle assembled in said nozzle, forming a cold water inflow space with an inner cavity of said nozzle, and forming a cold water jetting outlet with said cold water outlet; and a throat pipe disposed in connection with said mixing outlet of said valve body, adapted for discharging mixed water;

a rotatable member rotatably disposed in said valve body in a sealing manner; said rotatable member being axially movable relative to said nozzle and fitted therewith through an axially adjusting mechanism, so as to displace said nozzle in the axial direction of said needle by the rotation of said rotatable member;

wherein said needle is unmovable in the axial direction of said adjustable jet valve; said nozzle is movable in the axial direction of said adjustable jet valve; and fluid flow rates of said cold water inflow space, said hot water port and said cold water jetting outlet are adjusted simultaneously through axially adjusting said nozzle; and wherein said rotatable member is in connection with said needle, so as to actuate said needle to rotate simultaneously; said valve body is coordinated with said nozzle through a rotation limiting part, adapted for stopping said nozzle to rotate relative to said valve body when said needle is rotated by said rotatable member.

2. The adjustable jet valve according to claim 1, wherein said axially adjusting mechanism comprises an internal thread formed on said nozzle and an external thread formed on said rotatable member and adapted for being engaged with said internal thread; and the stroke for engagement of said internal thread and said external thread is no less than the working stroke of said nozzle.

3. The adjustable jet valve according to claim 1, wherein said rotation limiting part is a polygonal end portion formed on said nozzle, and the inner wall of said valve body is fitted therewith.

4. The adjustable jet valve according to claim 1, wherein said rotation limiting part comprises a flange and/or a guiding groove circumferentially arranged in the external wall of said nozzle, and a guiding groove and/or a flange axially arranged in the inner wall of said valve body fitted therewith.

5. The adjustable jet valve according to claim 4, wherein said cold water inlet and said cold water outlet of said nozzle have a pair of circumferential flanges formed therebetween extending radially outward, and said circumferential flanges allow a sealing element to be disposed therebetween, and a hot water segment of said nozzle located between said circumferential flanges and said cold water outlet is able to be communicated with a hot water passage of the valve.

6. The adjustable jet valve according to claim 1, wherein said throat pipe is assembled in said valve body formed said hot water port thereon in connection with the hot water passage and said throat pipe, and said throat pipe comprises a path pipe and an expanding pipe.

7. The adjustable jet valve according to claim 6, wherein said path pipe has an inner diameter between 5 mm and 14 mm, and the length of said path pipe is 5 to 8 times of said inner diameter.

8. The adjustable jet valve according to claim 6, wherein said expanding pipe has an expanding angle (β) between 5° and 15°.

9. The adjustable jet valve according to claim 8, wherein said expanding pipe is expanding gradually from its small end to its big end.

10. The adjustable jet valve according to claim 9, wherein said expanding pipe expands in three steps manner.

11. The adjustable jet valve according to claim 1, wherein said needle comprises a needle body and a conical portion located on one end of said needle body and coordinated with said cold water outlet of said nozzle; said needle body is circumferentially provided with a supporting member so as to allow outer surface of said supporting member to coordinate with the inner cavity of said nozzle, in order to limit the position of said needle body and to form a fluid passage on said supporting member, as said needle is disposed inside said nozzle.

12. The adjustable jet valve according to claim 11, wherein said supporting member comprises a plurality of ribs circumferentially and uniformly arranged around said needle body in the axial direction, and said fluid passage is formed between said ribs.

13. The adjustable jet valve according to claim 12, wherein said rib comprises a first rib part and a second rib part; said first rib part is arranged towards said cold water inlet of said nozzle and has a radial dimension smaller than that of said second rib part, so as to coordinate with said inner wall of said nozzle to form said fluid passage, and the outer surface of said second rib part is fitted with the inner cavity of said nozzle.

14. The adjustable jet valve according to claim 12, wherein the number of said ribs is three or four or five or six; the sum of the cross section of all fluid passages formed between said ribs is larger than the cross section of said cold water outlet of said nozzle.

15. The adjustable jet valve of claim 11, wherein a water pressurizing and mixing segment is disposed between said conical portion and said supporting member of said needle body, and the shape of said water pressurizing and mixing segment is a cylinder.

16. The adjustable jet valve according to claim 15, wherein the diameter of said water pressurizing and mixing segment is larger than, equal to or slightly smaller than the diameter of a spout of said nozzle.

17. The adjustable jet valve according to claim 16, wherein the diameter of said conical portion declines from its root to its front end, the taper of which is between 10° and 150° and the length of said conical portion is smaller than or equal to the movable stroke of said nozzle.

18. The adjustable jet valve according to claim 1, wherein when said nozzle is displaced in the axial direction of said adjustable jet valve, the pressure of cold water of said cold water inlet disposed thereon is always consistent with the pressure of cold water of said cold water port disposed on said valve body.

* * * * *